US006298920B1

(12) United States Patent
Keller

(10) Patent No.: US 6,298,920 B1
(45) Date of Patent: Oct. 9, 2001

(54) METHOD AND APPARATUS FOR REMOVING A RIGID LINER FROM WITHIN A CYLINDRICAL CAVITY

(76) Inventor: Carl E. Keller, P.O. Box 9827, Santa Fe, NM (US) 87544

( * ) Notice: Subject to any disclaimer, the term of this patent is extended or adjusted under 35 U.S.C. 154(b) by 0 days.

(21) Appl. No.: 09/484,299

(22) Filed: Jan. 18, 2000

Related U.S. Application Data

(60) Provisional application No. 60/120,270, filed on Feb. 16, 1999.

(51) Int. Cl.[7] ..... E21B 23/00; E21D 11/00

(52) U.S. Cl. ..... 166/377; 166/77.1; 166/85.1; 405/146; 405/150.1

(58) Field of Search ..... 166/77.1, 85.1, 166/242.2, 377, 380, 381; 405/146, 150.1

(56) References Cited

U.S. PATENT DOCUMENTS 2,998,065 * 8/1961 Hildebrandt ..... 166/278
5,044,405 * 9/1991 Driver et al. ..... 138/98
5,119,862 * 6/1992 Maimets et al. ..... 138/98
5,803,666 * 9/1998 Keller ..... 405/146
5,816,345 * 10/1998 Keller ..... 175/53
5,853,049 * 12/1998 Keller ..... 166/380
6,026,900 * 2/2000 Keller ..... 166/250.01
6,129,199 * 10/2000 Schwert et al. ..... 138/98

* cited by examiner

*Primary Examiner*—David Bagnell
*Assistant Examiner*—Jennifer Dougherty

(57) ABSTRACT

A cylindrical cavity is continuously contacted while removing a rigid liner from within the cavity. The supporting apparatus includes a flexible liner insertable within the rigid liner, having an expanded diameter greater than a diameter of the cavity, and having a top end and closed bottom end. A hollow conduit is attached to the bottom end of the flexible liner and has an opening adjacent the bottom end for introducing a fluid to expand the flexible liner against the cavity and contact the cavity as the rigid liner is withdrawn from about the flexible liner.

14 Claims, 4 Drawing Sheets

FIG. 1A
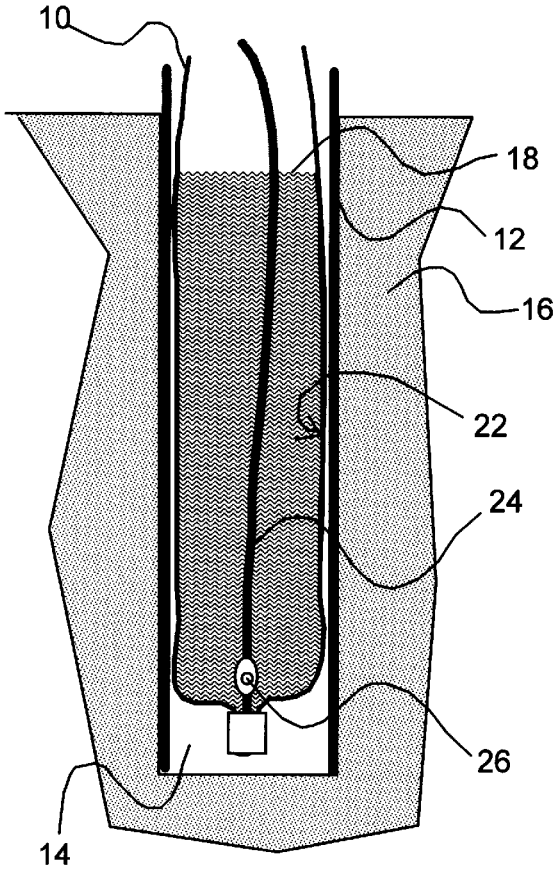
FIG. 2
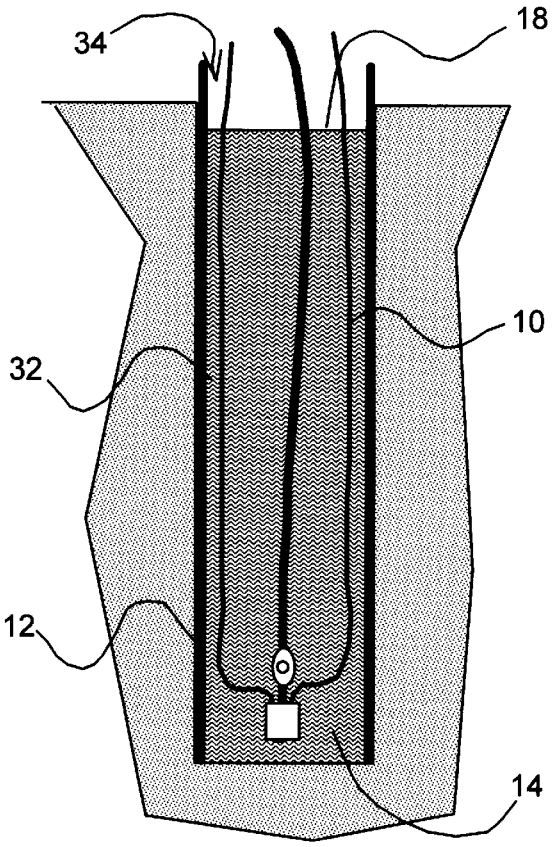
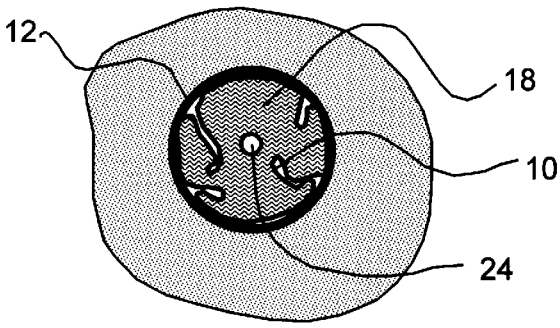
FIG. 1B

FIG. 5A
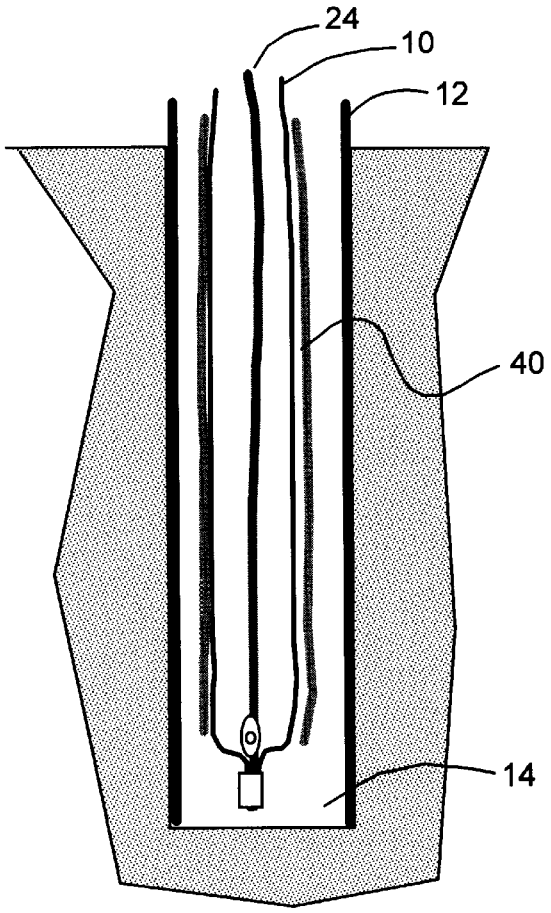
FIG. 6
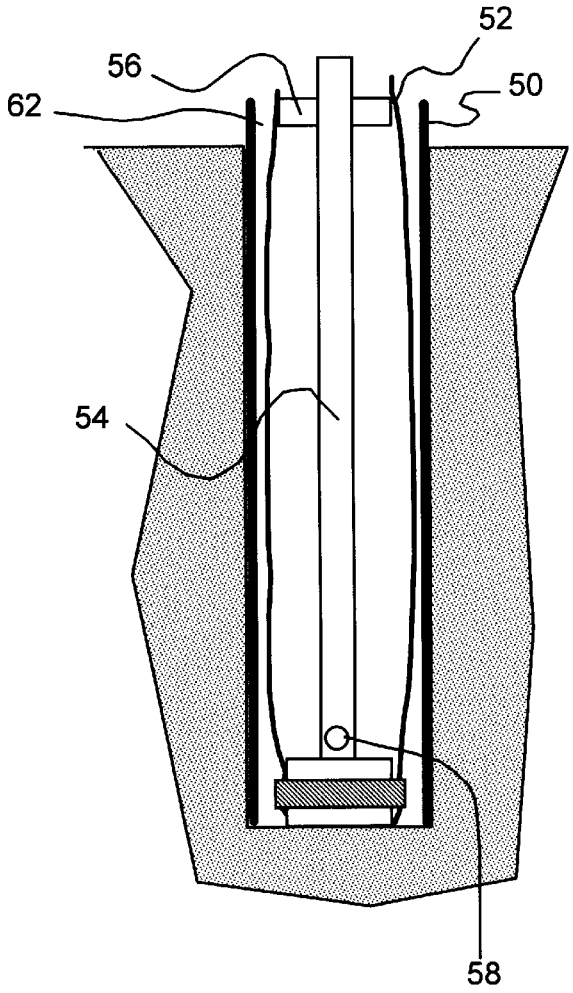
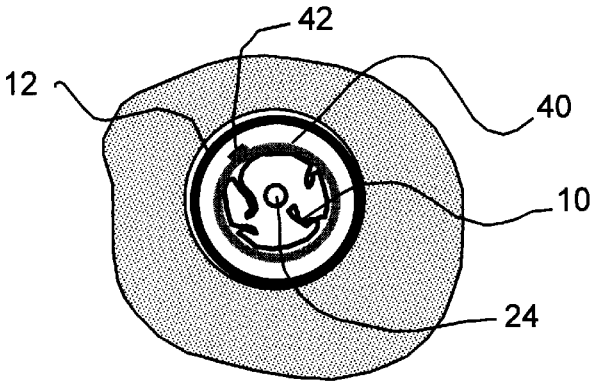
FIG. 5B

METHOD AND APPARATUS FOR REMOVING A RIGID LINER FROM WITHIN A CYLINDRICAL CAVITY

RELATED APPLICATIONS

This application claims the benefit of provisional application Ser. No. 60/120,270 filed Feb. 16, 1999.

FIELD OF THE INVENTION

The present invention relates generally to removal of rigid liners from within cylindrical cavities, and, more particularly, to the use of inflated liners to contact the cylindrical cavity while removing rigid liners.

BACKGROUND OF THE INVENTION

The installation of flexible supporting and sealing liners is described in U.S. Pat. Nos. 5,176,207, 5,803,666, and 6,026,900. In some cases, it is desirable to temporarily insert a rigid liner within a cylindrical cavity, such as a borehole, and to then replace the rigid liner with a flexible inflated liner with contact between the inflated liner and the cylindrical cavity during the replacement procedure.

However, if one inflates a flexible liner inside a rigid pipe of the same or less diameter, the flexible liner can not be easily withdrawn from the pipe, nor can the pipe be easily removed from off the flexible liner because of the excessive drag of the inflated flexible liner on the rigid liner. The pressure of the inflated flexible liner against the pipe wall and the large surface area of the pipe combine to produce very large drag resistance to sliding the pipe off the flexible liner. For example, a differential pressure of 1 psi in a 10 ft. long flexible liner inside a 4 in. diameter pipe, with a drag coefficient of 1.0, requires over 1500 lbs of force to pull the inflated liner out of the pipe. Such a large force may tear the flexible liner. As the pipe length increases to that of common well depths, the larger drag force is certain to tear the flexible liner.

It is common practice to emplace a rigid liner (e.g., a pipe) to support a drill hole wall while drilling a well. It may then be useful to replace the rigid liner support of the hole wall with the support of an inflated flexible liner. However, if the inflated liner is anchored to the bottom of the hole, and one pulls upward on the rigid liner, the drag of the rigid liner on the inflated liner prevents the rigid liner from being removed from the hole without a potentially destructive drag force on the flexible liner.

The present invention eliminates most of the drag force of a rigid liner on the inflated liner without the use of a lubricant to reduce the friction coefficient.

Various objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, as embodied and broadly described herein, the present invention includes apparatus for continuously contacting a cylindrical cavity while removing a rigid liner from within the borehole. The apparatus includes a flexible liner insertable within the rigid liner, having an expanded diameter greater than a diameter of the borehole, and having a top end and closed bottom end. A hollow conduit is attached to the bottom end of the flexible liner and has an opening adjacent the bottom end for introducing a fluid to expand the flexible liner against the cylindrical cavity and contact the cylindrical cavityl as the rigid liner is withdrawn from about the flexible liner.

In another characterization of the present invention, a cylindrical cavity is continuously contacted while removing a rigid liner from within the cavity. A flexible liner is inserted within the rigid liner, the flexible liner having an inflated diameter greater than the cavity diameter and forming an annulus with the rigid liner. The flexible liner is first filled with a fluid. The annulus between the rigid liner and the flexible liner is then filled with a fluid to equalize with the pressure of the fluid within the flexible liner. The rigid liner is withdrawn from the cavity while adding fluid to maintain the fluid level within the flexible liner as the flexible liner expands against the cavity as the rigid liner is withdrawn.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIGS. 1A and 1B show a side cross-section and a top cross-section, respectively of a rigid liner filled with a liquid inflated flexible liner.

FIG. 2 is a side cross-section of the liner shown in FIG. 1A with the introduction of a liquid between the rigid liner and the inflated liner.

FIGS. 5A and 5B are cross-sections of an embodiment using a sheath to compress the flexible liner in slender pipes.

FIG. 6 is a cross-section of an embodiment using a central support for large diameter pipes.

DETAILED DESCRIPTION

Figure 3:
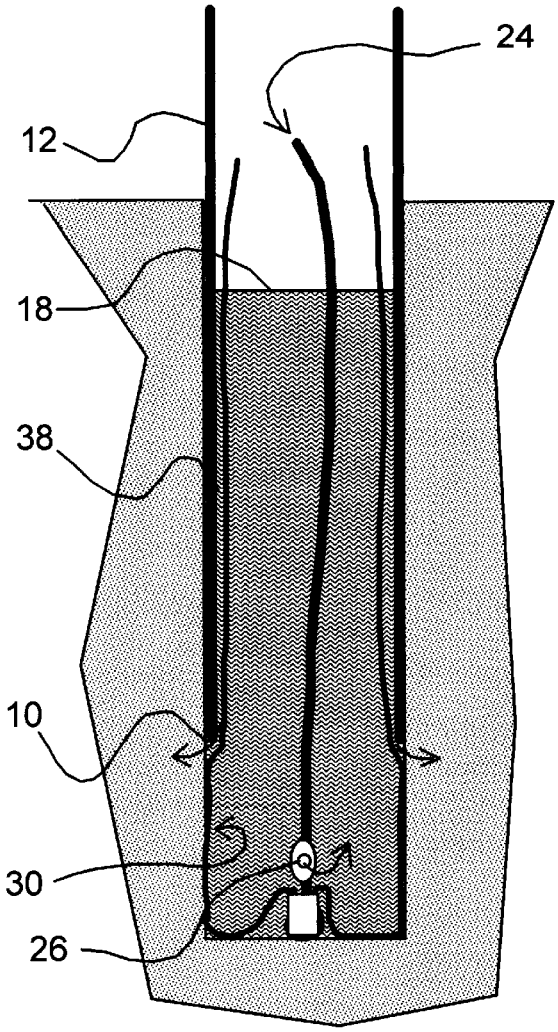
FIG. 3 is a side cross-section to illustrate the flexible liner partially extended beneath the rigid liner and expanded to anchor the flexible liner to the hole wall.

In accordance with the present invention, a rigid liner can be withdrawn from about an inflated flexible liner that expands to fill the space occupied by the rigid liner. FIGS. 1A and 1B show flexible liner 10 located inside of rigid liner 12. Rigid liner 12 is shown within a cylindrical cavity, e.g., a drill hole 14 in earth 16 for clarity of the application. In FIG. 1, flexible liner 10 is inflated with water 18.

Preferably, central tube 24, shown FIGS. 1A and 1B, is for the injection of a fluid, generally water, through bottom end 26 of central tube 24 as explained next. Fluid could be added from the top of flexible liner 10, but central tube 24 is convenient for introducing the fluid. The pressure 22 of water 18 against flexible liner 10 wall forces flexible liner 10 against the inside surface of rigid liner 12. If rigid liner 12 were lifted from hole 14, the drag of flexible liner 10 on rigid liner 12 is so large that the entire flexible water filled liner 10 would be lifted with rigid liner 12 or would be torn.

If flexible liner 10 were suitably anchored at its bottom end to the bottom of hole 14, e.g., by the weight of the fluid in liner 10, rigid liner 12 can be lifted from the hole only by pulling with a force greater than the drag friction, which is equal to P*C*F*L, where P is the average pressure, C the circumference of rigid liner 12, F the friction coefficient of flexible liner 10 on rigid liner 12, and L the length of the contact between the liners. This drag force is often greater than the tensile strength of flexible liner 10. Therefore, rigid liner 12 can not be drawn from the hole without damage to flexible liner 10, if flexible liner 10 is anchored in hole 14.

FIG. 2 shows the process of this invention. A small quantity of water is added to annular space 34 between flexible liner 10 and rigid liner 12. The gravity driven flow of the water downward in space 34 between flexible liner 10 and rigid liner 12 causes a fluid pressure to be applied to the outside of flexible liner 10. In some instances, flexible liner 10 may be raised and stretched to aid the downward flow of the annular water. The annular fluid pressure becomes equal to the interior pressure of flexible liner 10 or flexible liner 10 will be displaced until the fluid pressures equilibrate. The water levels in flexible liner 10 and in annular space 34 become equal. The effect is to eliminate the differential pressure that was forcing flexible liner 10 against rigid liner 12. Since flexible liner 10 is no longer pressing against rigid liner 12, the drag of flexible liner 10 against rigid liner 12 becomes very small. The only drag remaining is due to the confinement of flexible liner 10 within rigid liner 12. This may be further reduced as discussed below.

Once the differential pressure in flexible liner 10 is small, rigid liner 12 may be lifted from the hole, leaving flexible liner 10 in place. However, when flexible liner 10 is resting against the wall of hole 14, which is uncovered as rigid liner 12 is raised, the fluid in the annular space 34 is lost to the formation and the full differential pressure of the water head in flexible liner 10 forces flexible liner 10 against the hole wall. The force of flexible liner 10 against the hole wall is a very strong stabilizing force, preventing hole collapse. The strong force of flexible liner 10 against the hole wall also causes flexible liner 10 to drag against the hole wall, and tends to anchor flexible liner 10 in hole 14, further resisting the lifting of flexible liner 10 as rigid liner 12 is raised.

FIG. 3 shows rising rigid liner 12 with the dilation 30 of flexible liner 10 against the hole wall as rigid liner 12 exposes the hole wall. This mechanism is very useful to the emplacement of flexible liners inside unstable holes. As rigid liner 12 is lifted, water is added to the interior of flexible liner 10 via central tube 24 to compensate for the increasing volume 30 of flexible liner 10 as it dilates against the wall. The water level in annulus 38 is maintained as necessary. Often, rigid liner 12 and flexible liner 10 are filled near the top of rigid liner 12. In practice, the top section of rigid liner 12 is removed as rigid liner 12 is raised. This allows continued access to the top of flexible liner 10 and central tube 24.

The drag reduction of this technique can be more than a thousand-fold in rigid liners of 100 ft. lengths.

Figure 4:
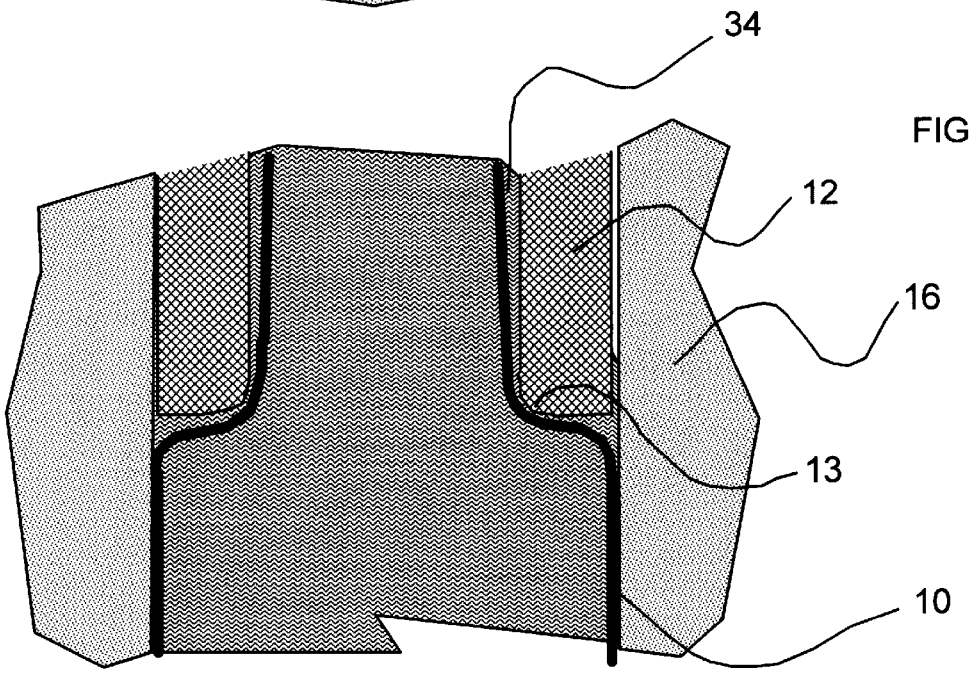
FIG. 4 is an expanded cross-section of a preferred shape of the bottom end of the rigid liner.

FIG. 4 shows the preferred rounded shape of the bottom edge 13 of rigid liner 12 to prevent scarring or cutting of flexible liner 10 as it dilates against the hole wall. If the differential pressure inside flexible liner 10 is plotted, it is essentially zero over most of the length of rigid liner 12. However, at the bottom end 13 of rigid liner 12, the differential pressure must be a continuous, monotonic distribution between zero, inside rigid liner 12 and annulus 34, and the full differential pressure, outside rigid liner 12. The length of this transition region has a direct effect on the drag that must be associated with any non-zero differential pressure. The longer the transition, the greater the drag. The shape of bottom 13 of rigid liner 12 can reduce the risk of damage, but it can also reduce the length of the transition by effecting a partial seal against leakage of the annular water out of rigid liner 12. This procedure works best when there is less loss of the annular water 34 as rigid liner 12 is withdrawn.

FIGS. 5A and 5B are a side cross-section and a top cross-section, respectively, of an embodiment using a compressive sheath 40 for installation of flexible liner 10 inside a very small diameter rigid liner 12 (e.g., less than 2"i.d.). The emplacement of flexible liner 10 into the interior of rigid liner 12 is an essential part of the procedure of supporting the hole with a flexible liner or for other similar situations described under "Applications." Compressive sheath 40 allows flexible liner 10 to be lowered or pushed inside rigid liner 12. Compressive sheath 40 is a tubular sleeve of suitable flexible material (e.g., tubular plastic film or woven fabric). Sheath 40 is pulled over flexible liner 10 before flexible liner 10 is lowered into rigid liner 12. Sheath 40 is typically sewn with a weak seam 42 so that after flexible liner 10 is placed in rigid liner 12, sheath 40 is split by applying an internal fluid pressure within flexible liner 10 via central tube 24. Seam 42 separates to liberate flexible liner 10, which expands against the wall of hole 14, forming a good anchor of flexible liner 10 in hole 14 as rigid liner 12 is withdrawn, as described for FIGS. 1–3.

FIG. 6 illustrates the application of the present invention to large diameter rigid liners 50. Flexible liner 52 does not stand in rigid liner 50 without support as it does in a small diameter rigid liner. For a large diameter rigid liner 50, a device consisting of a slender pipe 54 is lowered into flexible liner 52. The top of flexible liner 52 is attached to the top of slender pipe 54. Pipe 54 holds liner 52 upright in rigid liner 50 like a "tent pole". In this case, no additional central tube is needed as pipe 54 serves as the conduit of fluid to the bottom of flexible liner 52. A hole 58 at the bottom of pipe 54 allows the fluid to flow into the interior of flexible liner 52. As rigid liner 52 is raised, the fluid must still be added to the interior of flexible liner 52.

Figure 7:
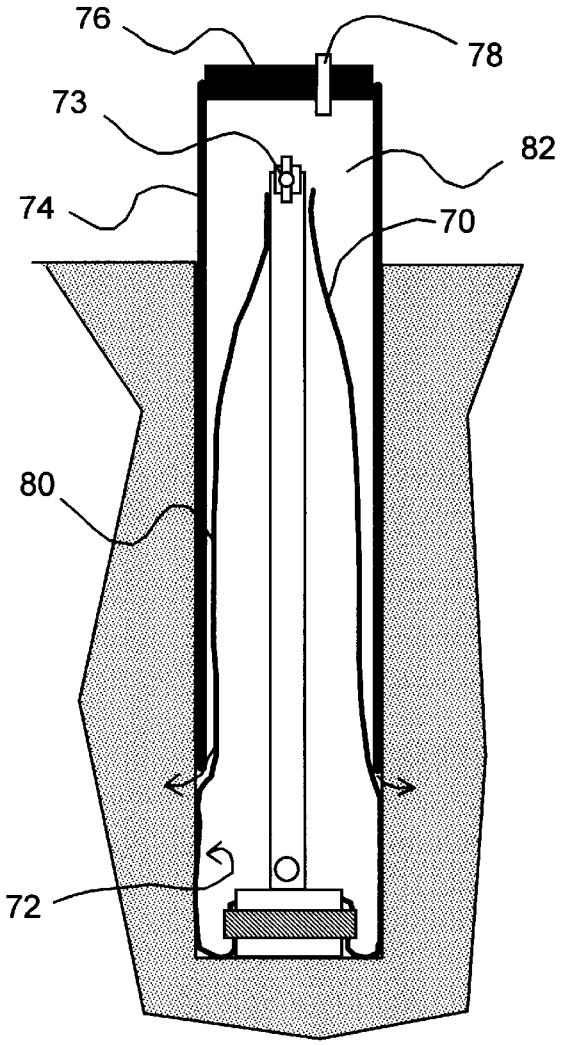
FIG. 7 is a cross-section of an embodiment using air as the fluid in the system.

FIG. 7 shows the geometry of the flexible/rigid liner system when air is used as the driving fluid instead of a liquid. In this case, flexible liner 70 is pressurized with air, or any other suitable gas, to develop the desired supporting pressure desired of flexible liner 70 against the hole wall 72. The air pressure develops a differential pressure and associated drag against rigid liner 74. Cap 76 is placed on top of rigid liner 74 and air is injected 78 into the top end of rigid liner 74 at a pressure equal to the pressure in flexible liner 70 (or slightly higher). The injected air flows into annular space 80 between flexible liner 70 and rigid liner 74 wall to eliminate the differential pressure in flexible liner 70. This allows rigid liner 74 to be lifted out of the hole and off of flexible liner 70 with relative ease and with limited drag on flexible liner 70. In practice, the drag can be so small that rigid liner 74 is forced off flexible liner 70 by the pressure against the top end cap 76 of rigid liner 74, much like a hydraulic cylinder and piston.

Figure 8:
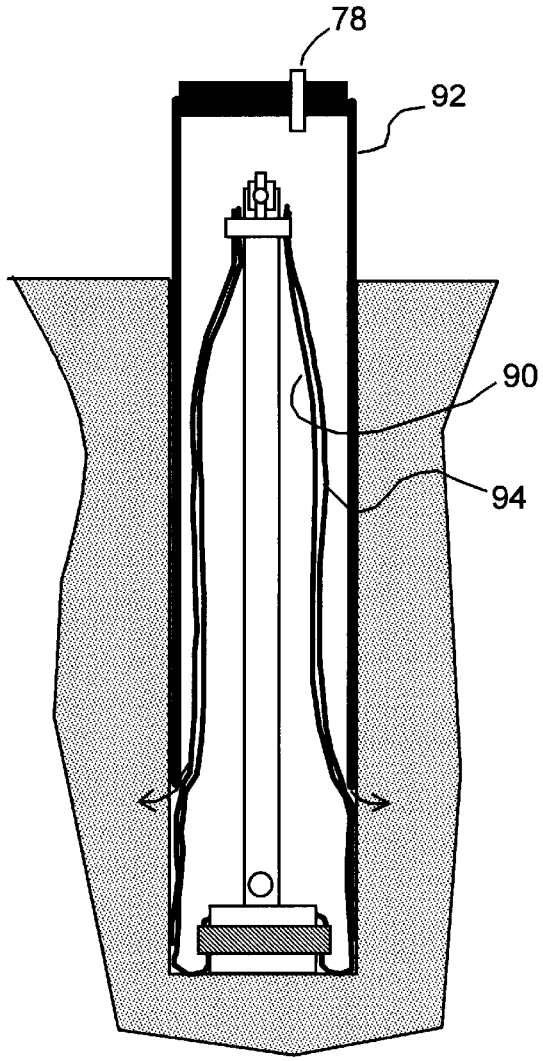
FIG. 8 is a cross-section of an embodiment using a covering for enhancing the friction reduction.

FIG. 8 shows the use of an impermeable covering 94 to further reduce the friction between flexible liner 90 and rigid liner 92. The mechanism of the drag reduction is to shorten the transition length, discussed above, and to decrease the friction coefficient between flexible liner 90 and rigid liner 92. Covering 94 prevents the annular fluid from leaking out of rigid liner 92 in the folds of flexible liner 90 (see FIG.

1B). This reduces the length of the transition of the differential pressure from the full pressure to zero, because the permeability of the flow path out of the annulus is decreased by the covering. The reduced permeability steepens the gradient for a given pressure drop, hence the reduction of the transition length. In fact, if the covering is not sealed at the top of the flexible liner, the friction is not reduced. The transition length inferred from drag measurements is reduced to a couple of inches instead of the more common 2–3 ft. Another effect of the covering is to reduce the friction coefficient in the transition region, since cover 94 can be a material with a low coefficient of friction, such as a plastic film (nylon, polyethylene, Teflon). With covering 94 on flexible liner 90, the measured drag was reduced a hundred-fold. This is in addition to the thousand-fold reduction due to the annular fluid addition described above.

The logical reverse of this method also has many applications. Instead of applying a fluid pressure to the annular space between a flexible and rigid liner, one can apply a vacuum. The effect is to increase the friction instead of reducing the friction. This can be used to anchor a flexible liner inside of a rigid liner such as a pipe. The drag friction can be much stronger than other kinds of connectors such as a vacuum coupling. Hence a quick and very strong connection can be effected to lift or pull extremely heavy loads. The highest friction can be obtained by a pressure in flexible liner 90 and a vacuum in rigid liner 92 (see FIG. 7 with a vacuum drawn through the end fitting 78.

Examples of the application

The application for which this technique was invented was to allow a flexible liner to be inserted into a rod that has been pushed 50–100 ft. into the earth. The liner is inserted in a central hole in the rod, the rod raised, the water added to the interior and exterior of flexible liner and the rod is then removed in sections from the hole. The flexible liner dilates in the hole as it is exposed by the rod removal, but the flexible liner does not dilate significantly in the rod. Without annular water addition, the liner is torn off because of the friction in the rod. In the application to small diameter rigid liners, the flexible liner may be compressed with a sheath to allow it to be emplaced in the rod.

This mechanism is also useful for the emplacement of flexible liners with an outer covering that reacts to the presence of contaminants in the ground water. The flexible liner is again emplaced in the rod, the rod removed, the reaction occurs. Thereafter, the flexible liner is inverted from the hole so as to prevent the contact of the reactive covering with any other portion of the hole. On the surface, the reactive covering is surveyed for the location of subsurface deposits of solvents and other contaminants that react with the covering.

Larger liners can be emplaced in larger rigid liners, like sonic driven casing, a common drilling method. The rigid liner is driven to support the hole during the drilling procedure. The flexible liner is emplaced and the rigid liner removed. The flexible liner can be fitted with multi-level water sampling hardware and other instruments. The internal pressure of the flexible liner prevents hole wall collapse and assures a good seal against vertical water transport in the hole. This emplacement may require the use of a central support with the flexible liner.

A rigid liner can be lowered into the interior of a hollow stem auger drilling device. The flexible liner can be installed in the rigid liner inside the hollow stem of the auger. As the hollow stem auger is removed, the rigid liner can be raised with the auger, leaving the flexible liner in place below the auger to support the hole wall and to emplace a variety of devices. Using a low friction covering to drastically reduce the friction, and using air to provide the annular fluid, the rigid liner may actually rise off the flexible liner and press against the top end of the rising auger. This greatly reduces the complexity of installing flexible liners in hollow stem augered holes.

There are many other flexible liner installations possible with this technique where the flexible liner (e.g., a cure-in-place sewer liner) can be carried into position by a rigid liner inside a sewer or other pipe and the rigid emplacement liner can be removed by this means of eliminating the differential pressure of an internally pressurized liner. The cure-in-place liner can be pressurized to force the cure-in-place liner against the sewer pipe wall as the rigid liner is removed. The advantage of this approach is that the resin of a cure-in-place liner can be maintained, uniformly distributed in the matrix material until it is positioned against the wall of the passage to be relined or reinforced.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Apparatus for supporting a borehole wall while removing a rigid liner from within a cylindrical cavity, the apparatus comprising:

a flexible liner insertable within the rigid liner, having an expanded diameter greater than a diameter of the cavity, and having a top end and closed bottom end; and a hollow conduit extending to the bottom end of the flexible liner and having an opening adjacent the bottom end for introducing a fluid to expand the flexible liner against the cavity and contact the borehole wall as the rigid liner is withdrawn from about the flexible liner.

2. Apparatus according to claim 1, further including a sheath having a diameter less than the diameter of the rigid liner for confining the flexible liner to a diameter less than the diameter of the cavity, where the sheath has a longitudinal seam effective to separate as the flexible liner is expanded within the rigid liner and cavity.

3. Apparatus according to claim 1, wherein the conduit is a rigid pipe having a collar at a top end for engaging the top end of the flexible liner to support the flexible liner within the rigid liner before the flexible liner is expanded against the cavity.

4. Apparatus according to claim 1, further including a cap engaging the rigid liner and having a fitting for injecting high pressure fluid between the rigid liner and the flexible liner to maintain separation between the rigid liner and the flexible liner as the rigid liner is withdrawn from about the flexible liner.

5. Apparatus according to claim 1, further including a covering for the flexible liner having a low coefficient of friction to reduce the friction between the rigid liner and the flexible liner as the flexible liner expands about an end of the rigid liner as the rigid liner is withdrawn from about the flexible liner.

6. A method for removing a rigid liner from about a flexible liner, comprising the steps of:

inserting the flexible liner within the rigid liner while installed within a cylindrical cavity, the flexible liner having an inflated diameter greater than the rigid liner diameter and forming a annulus with the rigid liner;

filling the flexible liner with a fluid;

filling the annulus between the rigid liner and the flexible liner with a fluid to equalize with the pressure of the fluid within the flexible liner; and withdrawing the rigid liner from about the flexible liner while adding fluid to maintain the fluid level within the flexible liner when the flexible liner expands against the cylindrical cavity as the rigid liner is withdrawn.

7. A method according to claim 6, further including the steps of:

installing a sheath about the flexible liner to confine the flexible liner during insertion into the rigid liner, where the sheath has a weak longitudinal seam; and filling the flexible liner with a fluid to expand the flexible liner and cause the weak seam to separate as the flexible liner expands.

8. A method according to claim 6, further including the steps of attaching the flexible liner to a rigid cylinder to support the flexible liner within a rigid casing during insertion into the rigid liner.

9. A method according to claim 6, further including the steps of;

using air as the fluid for the flexible liner and the annulus;

pressurizing the flexible liner with air;

capping the rigid liner and injecting air into the annulus between the rigid liner and the flexible liner.

10. A method according to claim 6, further including the step of providing a material having a low coefficient of friction about the flexible liner to minimize friction between an end portion of the rigid liner and flexible liner when the flexible liner expands against the end portion as the rigid liner is withdrawn from about the flexible liner.

11. Apparatus for supporting a borehole wall while removing a rigid liner from within cylindrical cavity, the apparatus comprising:

a flexible liner insertable within the rigid liner, having an expanded diameter greater than a diameter of the cavity, and having a top end and closed bottom end; and a sheath having a diameter less than the diameter of the rigid liner for confining the flexible liner to a diameter less than the diameter of the cavity, where the sheath has a longitudinal seam effective to separate as the flexible liner is expanded within the rigid liner and cavity.

12. Apparatus according to claim 11, further including a covering for the flexible liner having a low coefficient of friction to reduce the friction between the rigid liner and the flexible liner as the flexible liner expands about an end of the rigid liner as the rigid liner is withdrawn from about the flexible liner.

13. Apparatus for supporting a borehole wall while removing a rigid liner from within cylindrical cavity, the apparatus comprising:

a flexible liner insertable within the rigid liner, having an expanded diameter greater than a diameter of the cavity, and having a top end and closed bottom end; and a cap engaging the rigid liner and having a fitting for injecting high pressure fluid between the rigid liner and the flexible liner to maintain separation between the rigid liner and the flexible liner as the rigid liner is withdrawn from about the flexible liner.

14. Apparatus according to claim 13, further including a covering for the flexible liner having a low coefficient of friction to reduce the friction between the rigid liner and the flexible liner as the flexible liner expands about an end of the rigid liner as the rigid liner is withdrawn from about the flexible liner.

* * * * *